US010172391B2

(12) United States Patent
Chen et al.

(10) Patent No.: US 10,172,391 B2
(45) Date of Patent: Jan. 8, 2019

(54) FILTER-TYPE DISTILLATION SUCTION APPARATUS

(71) Applicant: Smiss Technology Co., Ltd., Shenzhen, Guangdong (CN)

(72) Inventors: Jiatai Chen, Guangdong (CN); Xinyun Hu, Guangdong (CN)

(73) Assignee: Smiss Technology Co., Ltd., Shenzhen, Guangdong (CN)

( * ) Notice: Subject to any disclaimer, the term of this patent is extended or adjusted under 35 U.S.C. 154(b) by 110 days.

(21) Appl. No.: 15/340,764

(22) Filed: Nov. 1, 2016

(65) Prior Publication Data

US 2017/0258141 A1 Sep. 14, 2017

Related U.S. Application Data

(63) Continuation of application No. PCT/CN2016/081178, filed on May 5, 2016.

(30) Foreign Application Priority Data

Mar. 11, 2016 (CN) ..... 2016 1 0139170

(51) Int. Cl.
*A24F 47/00* (2006.01)
*A24F 7/04* (2006.01)
*H05B 3/46* (2006.01)

(52) U.S. Cl.
CPC ..... *A24F 47/008* (2013.01); *A24F 7/04* (2013.01); *H05B 3/46* (2013.01)

(58) Field of Classification Search
CPC ..... A24F 47/008; A24F 47/04
See application file for complete search history.

(56) References Cited

U.S. PATENT DOCUMENTS 3,601,133 A * 8/1971 Eck ..... A24D 3/045 131/210
5,403,387 A * 4/1995 Flynn ..... B01D 53/0415 96/143

(Continued)

FOREIGN PATENT DOCUMENTS

CN 201888252 7/2011
CN 103462224 12/2013

(Continued)

OTHER PUBLICATIONS

"Difference between Anatomy of a Glass on Glass Bong and a Rubber Grommet Bong." Online Smoke Shop with Hand Blown Glass—Water-Bongs-Glass-Pipes.com, Feb. 26, 2016, www.water-bongs-glass-pipes.com/blog/difference-between-anatomy-of-a-glass-on-glass-bong-and-a-rubber-grommet-bong-n126. (Year: 2016).*

(Continued)

*Primary Examiner* — Jacob T Minskey
*Assistant Examiner* — Taryn Trace Willett
(74) *Attorney, Agent, or Firm* — Hamre, Schumann, Mueller & Larson, P.C.

(57) ABSTRACT

A tobacco baking device, comprising a mouthpiece component, a baking component, and a filter component, where the filter component is located below a baking component; the mouthpiece component is located above the baking component; the baking component is detachably connected to the filter component; where there is sealed connection on the butted terminal portions of the mouthpiece component, the filtration component and the baking component; an air flow channel is provided between the mouthpiece component, the filter component, and the baking component. Vapor goes down along the air flow channel to the filtration component, and goes up after being filtered by the filter component and is released via the mouthpiece component. As the vapor is filtered by the filter component, harmful substances in the (Continued)

vapor are greatly reduced, and also cool the vapor and the whole device, so as to enable the device to be more suitable for using.

10 Claims, 8 Drawing Sheets

(56) References Cited

U.S. PATENT DOCUMENTS

| | | | | |
|---|---|---|---|---|
| 5,667,566 | A | 9/1997 | Flynn et al. | |
| 9,149,586 | B2 * | 10/2015 | Shen | A61M 11/041 |
| 9,623,205 | B2 * | 4/2017 | Buchberger | A24F 47/008 |
| 9,877,521 | B1 * | 1/2018 | Gillis | A24F 47/008 |
| 9,894,934 | B2 * | 2/2018 | Li | A61M 15/06 |
| 2011/0073120 | A1 * | 3/2011 | Adamic | A24F 1/00 131/328 |
| 2012/0000478 | A1 | 1/2012 | Wagenhals | |
| 2014/0130812 | A1 * | 5/2014 | Kling | A24F 47/008 131/173 |
| 2014/0182612 | A1 * | 7/2014 | Chen | A24F 47/008 131/329 |
| 2015/0208730 | A1 * | 7/2015 | Li | A61M 15/06 131/329 |
| 2015/0208731 | A1 * | 7/2015 | Malamud | H05B 1/0244 131/328 |
| 2015/0257443 | A1 * | 9/2015 | Rado | A24F 47/00 392/390 |
| 2015/0296885 | A1 | 10/2015 | Liu | |
| 2016/0331032 | A1 * | 11/2016 | Malgat | A24F 47/004 |
| 2017/0035112 | A1 * | 2/2017 | Thorens | A24F 47/008 |
| 2017/0055574 | A1 * | 3/2017 | Kaufman | A24F 47/004 |
| 2017/0055579 | A1 * | 3/2017 | Kuna | A24F 47/008 |
| 2017/0099873 | A1 * | 4/2017 | Benjamignan | A24F 1/30 |
| 2018/0280636 | A1 * | 10/2018 | Jiang | A61M 15/002 |

FOREIGN PATENT DOCUMENTS

| | | | |
|---|---|---|---|
| CN | 203555160 | | 4/2014 |
| CN | 203618772 | | 4/2014 |
| CN | 203676127 | U | 7/2014 |
| CN | 104082862 | A | 10/2014 |
| CN | 204070585 | | 1/2015 |
| CN | 204070585 | U * | 1/2015 |
| CN | 204483016 | | 7/2015 |
| CN | 105266206 | | 1/2016 |
| CN | 205456073 | U | 8/2016 |
| WO | 2014166037 | | 10/2014 |
| WO | 2015010349 | | 1/2015 |

OTHER PUBLICATIONS

International Search Report for PCT/CN2016/081178, dated Sep. 1, 2016. In Chinese with the exception of the table of related references (p. 5/5) which is in English, 12 pages.

Office Action issued in Chinese Patent Application No. CN201610139170.7 dated Oct. 26, 2017, 7 pages.

* cited by examiner

FILTER-TYPE DISTILLATION SUCTION APPARATUS

BACKGROUND

Technical Field

The present disclosure relates to the field of heating but not combustion technologies, and in particular, a filter-type distillation suction apparatus, and more particularly, a tobacco baking device.

Related Art

Compared with smoking cigarettes directly, the tobacco baking device is more healthy as smoking of baked tobacco with precise temperature controlled during baking which can also cut down the probability of producing harmful staff by tobacco, so people are more and more fond of tobacco baking devices.

However, as for current tobacco baking devices which bake the tobacco to produce vapor for smoking directly or filtered via a simply filter screen before smoking, the unhealthy substances such as dust of tobacco are also easily smoked; Moreover, it's easy to occur air leakage due to the air tightness of current tobacco baking devices is not good, and the devices have the feature of disposable, once the baking chamber damaged, it has to discard the whole device, can't just replace the chamber.

SUMMARY

In view of the above, the present disclosure provides a tobacco baking device, which aims at solving the problem that during smoking period much impurity absorbed in with vapor produced by current tobacco baking devices, and at the same time, reducing use costs of consumers, so as to be more environmentally friendly.

Technical solutions according to the present disclosure to solve the foregoing technical problem are as follows.

A tobacco baking device, comprising a mouthpiece component, a baking component, and a filter component, where the filter component is located below the baking component; the mouthpiece component is located above the baking component; the baking component is detachably connected to the filter component; where there is sealed connection on the butted terminal portions of the mouthpiece component, the filtration component and the baking component; and an air flow channel is provided among the mouthpiece component, the filter component, and the baking component; the baking component bake tobacco therein to generate vapor, and the vapor goes down along the air flow channel to the filter component, and goes up after being filtered by the filter component and is released via the mouthpiece component.

Further, the baking component is in a detachable connection to the filter component, and a silicon seal is provided at a joint between the baking component and the filter component; a positive electrode, a negative electrode, and a sensor electrode are provided on an end portion of the baking component, where the baking component is butted with the filter component; a power supply positive electrode, a power supply negative electrode, and a sensor electrode are provided on an end portion of the filter component, where the filter component is butted with baking component; when the baking component is fixedly connected to the filter component, the positive electrode on the end portion of the baking component is butted with the power supply positive electrode of the filter component; the negative electrode of the baking component is butted with the power supply negative electrode of the filter component; and the sensor electrode of the baking component is butted with the sensor electrode of the filter component.

Further, the filter component comprises an air inlet pipe, an air outlet pipe, a filter pipe, and an external pipe; where the air inlet pipe is inserted into the air outlet pipe, and a first space is formed between an outer wall of the air inlet pipe and an inner wall of the air outlet pipe; the air outlet pipe is inserted into the filter pipe, and a second space is formed between an outer wall of the air outlet pipe and an inner wall of the filter pipe; the filter pipe is inserted into the external pipe, and a third space is formed between an outer wall of the filter pipe and an inner wall of the external pipe; an airflow hole is provided on a pipe wall of the air inlet pipe and a pipe wall of the air outlet pipe; an airflow hole is provided on a bottom part of the filter pipe; a filtrate is provided in the second space and third space; and a height of the filtrate does not exceed the airflow hole's height on the pipe wall of the air outlet pipe.

Further, the air inlet pipe, the air outlet pipe, the filter pipe, and the external pipe are all hollow pipes.

Further, the filtrate is water or other liquid.

Further, the mouthpiece component is in a detachable connection to the baking component, and a silicon seal is provided at a joint between the baking component and the mouthpiece component.

Further, the baking component comprises a heater, an inner cavity, and an airflow pipe and a seal pipe that are provided outside of the heater; the airflow pipe is vertically connected to the seal pipe, and the seal pipe is provided below the airflow pipe; the inner cavity is provided in the heater; tobacco are provided in the inner cavity; and an airflow channel is formed between an inner wall of the airflow pipe and the seal pipe and an outer wall of the heater.

Further, the heater comprises a heat insulation pipe, heat insulation cotton, and a heating pipe; the heat insulation cotton is provided in the heat insulation pipe; the heating pipe is provided in the heat insulation cotton; a heat sensitive sensor is provided on an outer wall of the heating pipe; the heating pipe is connected to a positive electrode and a negative electrode on the baking component; and the heat sensitive sensor is connected to a sensor electrode on the baking component.

Further, the inner cavity is a tobacco pouch that is detachably mounted on the heater; multiple vent holes are provided on a wall of the tobacco pouch.

Further, an air inlet and an air outlet channel are provided on the mouthpiece component; an intake air via the air inlet is mixed with vapor and then goes down to the filter component; the air outlet channel is connected to the filter component and a mouthpiece of the mouthpiece component, so that vapor filtered by the filter component is released from the mouthpiece via the air outlet channel of the mouthpiece component.

The tobacco baking device implemented by the present disclosure is provided with a filter component, so that vapor generated by baked tobacco is smoked after being filtered, which not only decreases the temperature of vapor, but also filters impurities contained in vapor, so as to reduce harmful substances in vapor; secondly the baking apparatus is a detachable structure, so that replacing the components is convenient; the seal configuration of the entire tobacco baking device is more perfect, thereby reducing leakage risks.

| | | | |
|---|---|---|---|
| 100 | mouthpiece component | 1 | mouthpiece |
| 2 | movable ring | 3 | vent core |
| 31 | air inlet hole | 32 | air outlet hole |
| 4 | rubber ring | 5 | airflow pipe |
| 6 | seal pipe | 7 | vapor channel |
| 200 | baking component | 8 | heat insulation pipe |
| 9 | heat insulation cotton | 10 | ceramic heating pipe |
| 11 | tobacco pouch | 12 | air inlet pipe |
| 13 | air inlet hole on the wall of the air inlet pipe | 14 | air outlet pipe |
| 15 | filter pipe | 300 | filter component |
| 16 | external pipe | 17 | first space |
| 18 | second space | 19 | third space |
| 20 | air outlet hole on the wall of the air inlet pipe | 21 | air outlet hole on the wall of the air outlet pipe |
| 22 | air outlet hole on the wall of the filter pipe | 23 | injection hole |
| 24 | filtrate | 25 | negative electrode |
| 26 | positive electrode | 27 | power supply negative electrode |
| 28 | power supply positive electrode | 29 | NTC electrode I |
| 30 | NTC electrode II | | |

DETAILED DESCRIPTION

The following describes a specific implementation process and implementation effects of the present disclosure in detail with reference to the accompanying drawings.

Figure 1:
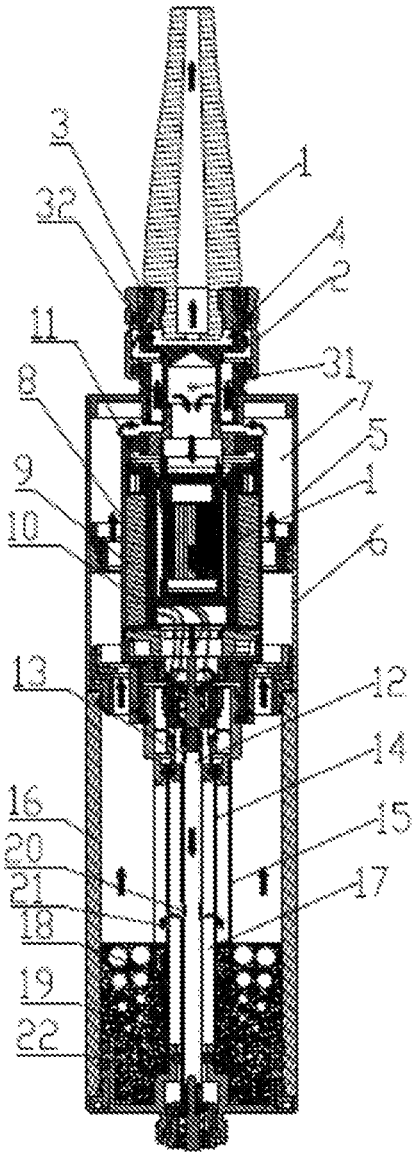
FIG. 1 is an overall schematic sectional view in an air inlet state of the present disclosure.

A tobacco baking device includes a mouthpiece component 100, a baking component 200, and a filter component 300; as shown in FIG. 1, the filter component 300 is located below the baking component 200; the mouthpiece component 100 is located above the baking component 200; the baking component 200 is in a detachable connection to the filter component 300; a communicated air flow channel is provided among the mouthpiece component 100, the filter component 200, and the baking component 300; after being heated, the baking component 200 bakes tobacco provided therein to generate vapor, and the vapor goes down along the air flow channel to the filter component, and goes up after being filtered by the filter component and is released via the mouthpiece component 100.

Figure 2:
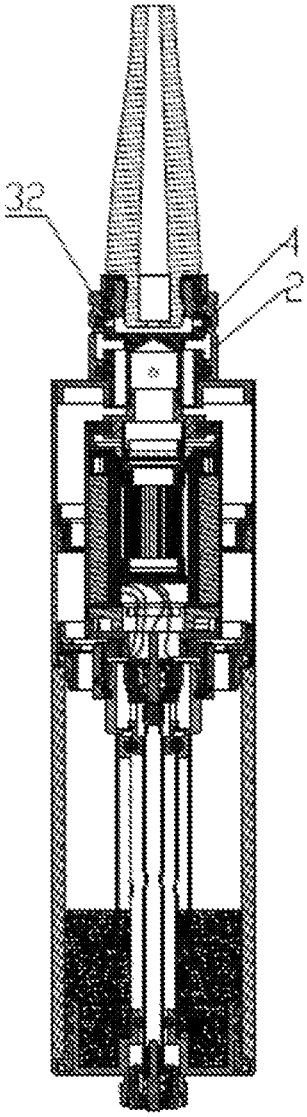
FIG. 2 is an overall schematic sectional view in an air shut-off state of the present disclosure.
Figure 3:
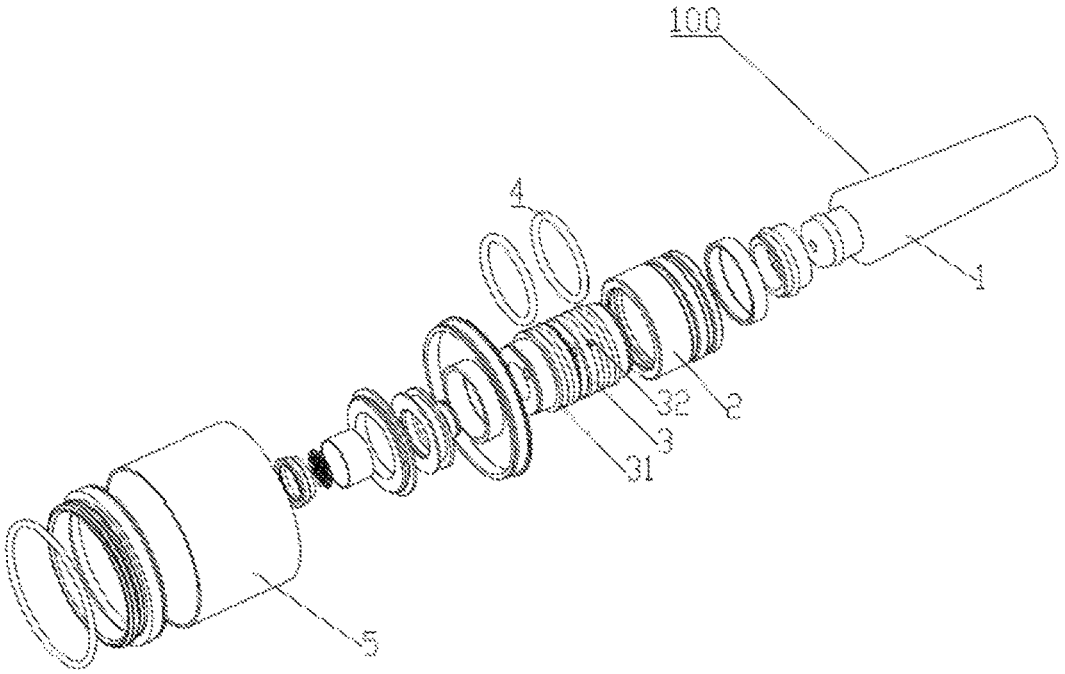
FIG. 3 is a schematic exploded view of the mouthpiece component of the present disclosure.

Specifically, as shown in FIG. 3 and FIG. 1, the mouthpiece component 100 includes a mouthpiece 1, which is used to contact human mouth for smoking; a through hole is provided in the mouthpiece for discharging filtered vapor. The mouthpiece 1 further includes a movable ring 2 and a vent core 3, where the movable ring 2 is provided outside the vent core 3; an air inlet hole 31 and an air outlet hole 32 are provided on the vent core 3; the air inlet hole 31 and the air outlet hole 32 are opposite perforations provided on a wall of the vent core, and they are set in a vertically-crossed manner; a peripheral plane where the air inlet hole 31 is located is not the same as a peripheral plane where the air outlet hole 32 is located; as shown in FIG. 1, preferably, the peripheral plane where the air inlet hole 31 is located is below the peripheral plane where the air outlet hole 32 is located. Two seal rings 4 are provided between the movable ring 2 and the vent core 4; the seal rings 4 are used to close the air inlet hole and the air outlet hole or separate the air inlet hole from the air outlet hole. Specifically, when the movable ring 2 moves upwards to a location where a limiting ring is located, it indicates that the air inlet hole and the air outlet hole on the vent core are in an open state, that is, the two seal rings move upwards with the movable ring 2 and disengage from locations of the air inlet hole 31 and the air outlet hole 32, so that the air inlet hole 31 and the air outlet hole 32 are in a communication state, that is, the state shown in FIG. 1; when the movable ring moves downwards to be far away from the limiting ring, the two seal rings move downwards with the movable ring 2 to the peripheral plane where the air inlet hole 31 is located and the peripheral plane where the air outlet hole 32 is located, so that the air inlet hole 31 and the air outlet hole 32 are blocked by the seal rings, it indicates that the air inlet hole 31 and the air outlet hole 32 are in a closed state, that is, the state shown in FIG. 2.

Figure 4:
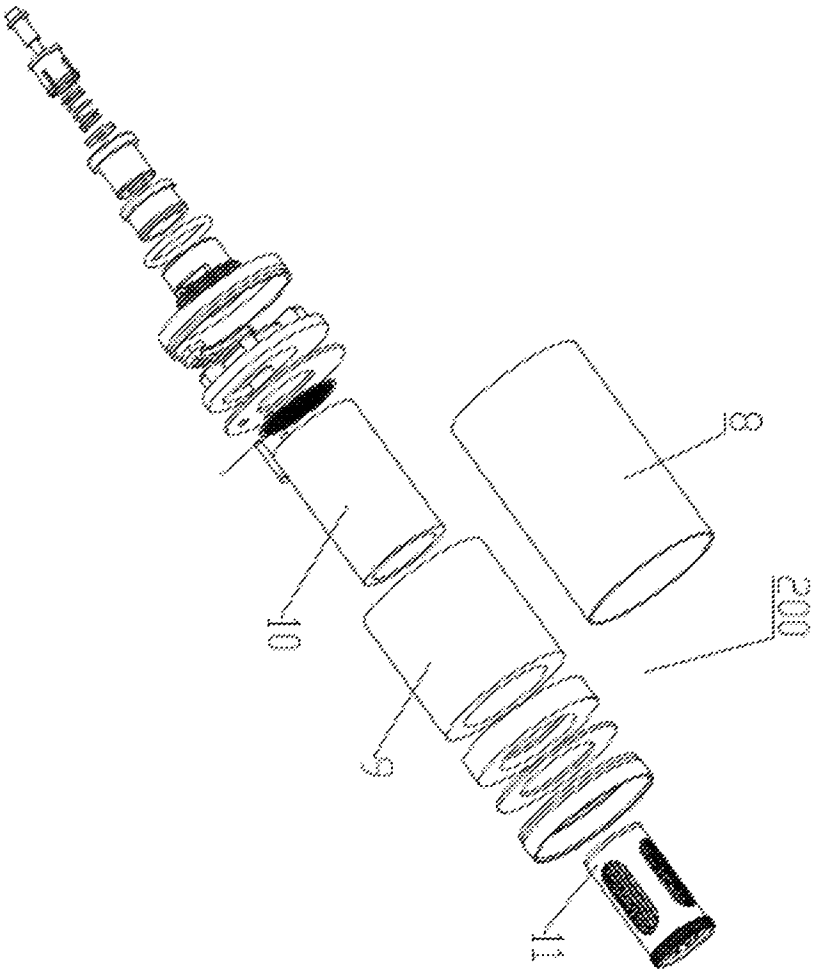
FIG. 4 is a schematic exploded view of a baking component of the present disclosure.

As shown in FIG. 4 and FIG. 1, the baking component 200 includes a heater and an inner cavity, where tobacco are provided, and the heater is used to bake the tobacco in the inner cavity. In this embodiment, the inner cavity is a tobacco pouch 11, which is a metal cylinder, and several through holes are provided on the wall of the tobacco pouch; tobacco are provided in the tobacco pouch.

Specifically, the heater includes a heat insulation pipe 8, heat insulation cotton 9, and a ceramic heating pipe 10; the heat insulation cotton 9 is provided in the heat insulation pipe 8; the ceramic heating pipe 10 is provided in the heat insulation cotton 9; and the ceramic heating pipe is connected to a heating circuit. An airflow pipe 5 and a seal pipe 6 are provided outside of the heat insulation pipe 8; the airflow pipe 5 is vertically connected to the seal pipe 6, and the seal pipe is provided below the airflow pipe; and an airflow channel is formed between the inner wall of the airflow pipe 5 and the seal pipe 6 and the outer wall of the heat insulation pipe 8. The ceramic heating pipe 10 is connected to the heating circuit, which accurately controls the heating temperature of the ceramic heating pipe 10 by using a heat sensitive sensor; the ceramic heating pipe 10 bakes tobacco in the tobacco pouch 11, so that vapor generated by baking the tobacco moves downwards with an air flow entered via the air inlet hole 31 into the filter component 300.

Figure 5:
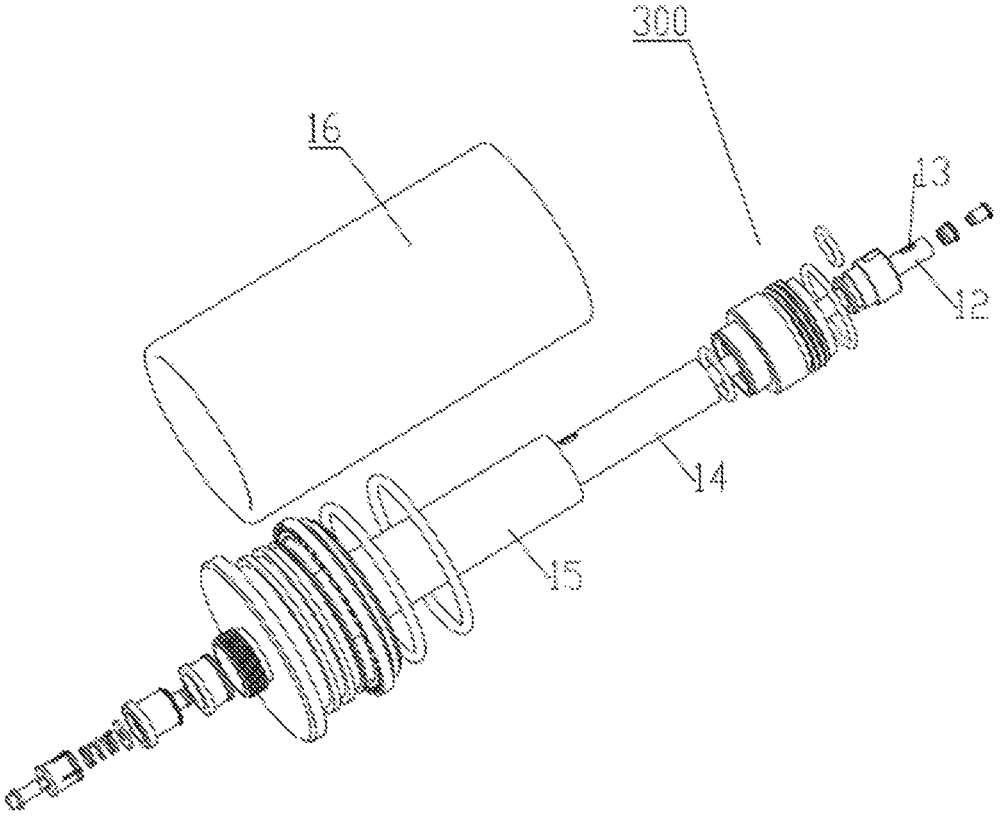
FIG. 5 is a schematic exploded view of a filter component of the present disclosure.

As shown in FIG. 5 and FIG. 1, the filter component 300 includes an air inlet pipe 12, an air outlet pipe 14, a filter pipe 15, and an external pipe 16; preferably, the air inlet pipe 12, the air outlet pipe 14, the filter pipe 15, and the external pipe 16 are all cylindrical hollow pipes; the air inlet pipe 12 is inserted into the air outlet pipe 14, and a first space 17 is formed between the outer wall of the air inlet pipe 12 and the inner wall of the air outlet pipe 14; the air outlet pipe 14 is inserted into the filter pipe 15, and a second space 18 is formed between the outer wall of the air outlet pipe 14 and the inner wall of the filter pipe 15; the filter pipe 15 is inserted into the external pipe 16, and a third space 19 is formed between the outer wall of the filter pipe 15 and the inner wall of the external pipe 16; an airflow hole is provided on the pipe wall of the air inlet pipe and the pipe wall of the air outlet pipe; an airflow hole is provided on the bottom part of the filter pipe 15; a filtrate is provided in the second space and third space; and the height of the filtrate does not exceed the height of the airflow hole on the pipe wall of the air outlet pipe, and the filtrate is water or other liquid.

Specifically, as shown in FIG. 1, the air inlet pipe 12 is connected to the airflow channel of the baking component; airflow holes provided on the wall of the air inlet pipe 12 are an air inlet hole 13 on the wall of the air inlet pipe and an air outlet hole 20 on the wall of the air inlet pipe; an airflow hole provided on the air outlet pipe 14 is an air outlet hole 21 on the wall of the air outlet pipe; and an airflow hole provided on the filter pipe 15 is an air outlet hole 22 on the wall of the filter pipe.

When the tobacco baking device is in an air inlet state, that is, the state shown in FIG. 1, air is sucked by a person at the mouthpiece 1, and air enters the air inlet hole 31 of the mouthpiece component, and the baking component 200 bakes tobacco in the tobacco pouch 11 to generate vapor; the vapor moves downwards with air that enters the air inlet hole 31, as the direction indicated by a downgoing arrow head in FIG. 1, and then the vapor enters the air inlet pipe 12 via the air inlet hole 13 on the wall of the air inlet pipe of the filter component 300, and then enters the first space 17 via the air outlet hole 20 on the wall of the air inlet pipe, and then enters the second space 18 via the air outlet hole 21 on the wall of the air outlet pipe; a filtrate is provided in the second space 18 and the third space 19; the filtrate is water in this embodiment; the smoke enters the third space 19 via the air outlet hole 22 on the wall of the filter pipe on the filter pipe 15 after being filtered by water; after coming out from the third space 19, the vapor enters an upgoing air flow channel, that is, goes up via a space between the outer wall of the heater insulation pipe 8 and the inner wall of the airflow pipe 5 and the seal pipe 6, and finally flows out of the mouthpiece via the air outlet hole 32 on the vent core of the mouthpiece component 100, and enters into the mouth of a smoker.

Figure 7:
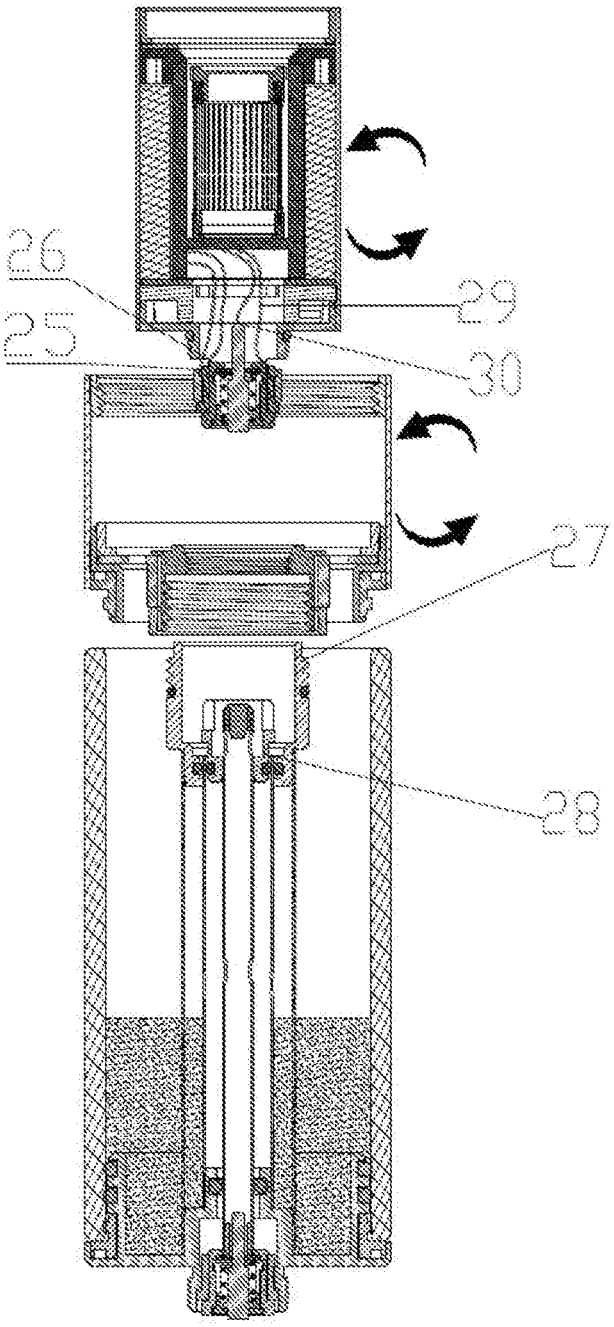
FIG. 7 is a schematic diagram of components in a separated state of the present disclosure.
Figure 8:
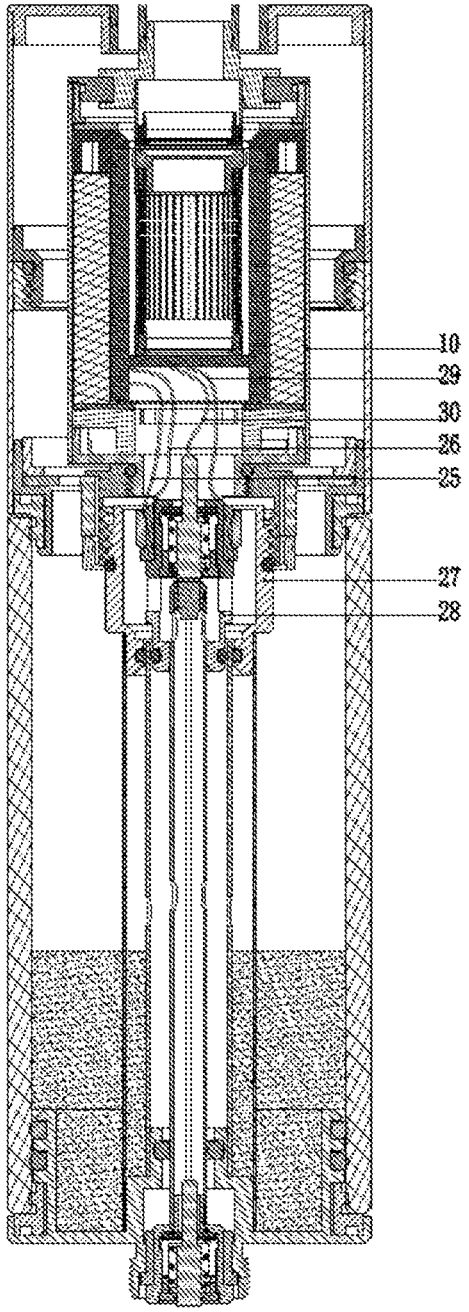
FIG. 8 is a schematic diagram of components in a combined state of the present disclosure.

To make it convenient for the filter component to add a filtrate, and to make it convenient for replacing the baking component, the baking component is in a detachable connection, for example, threaded connection, to the filter component; a tail end of the filter component is connected to a power supply component (not shown), and the power supply component supplies power to the baking component by using a conductor in the filter component. As shown in FIG. 7, a positive electrode 26, a negative electrode 25, and a sensor electrode are provided on an end portion of the baking component, where the baking component with the filter component is butted, herein the sensor electrode is an NTC electrode I 29 and an NTC electrode II 30 in FIG. 7; a power supply positive electrode 28, a power supply negative electrode 27, and a sensor electrode are provided on an end portion of the filter component, where the filter component is butted with the baking component; a heat sensitive sensor is provided on the outer wall of the ceramic heating pipe 10 in the baking component; the ceramic heating pipe 10 is connected to the positive electrode 26 and the negative electrode 25 on the baking component, and the heat sensitive sensor is connected to the sensor electrode on the baking component, that is, the NTC electrode I 29 and the NTC electrode II 30 in FIG. 7. When the baking component is fixedly connected to the filter component, as shown in FIG. 8, moreover, a center of the filter component is clipped to a center of the baking component, the positive electrode 26 of the end portion of the baking component is butted with the power supply positive electrode 28 of the filter component; the negative electrode 25 of the baking component is butted with the power supply negative electrode 27 of the filter component; the NTC electrode I 29 of the baking component is butted with the sensor electrode of the filter component; the NTC electrode II 30 is butted with the power supply positive electrode 28 of the filter component, and the power supply positive electrode 28 is shared by the NTC electrode II 30 and the positive electrode 26.

Figure 6:
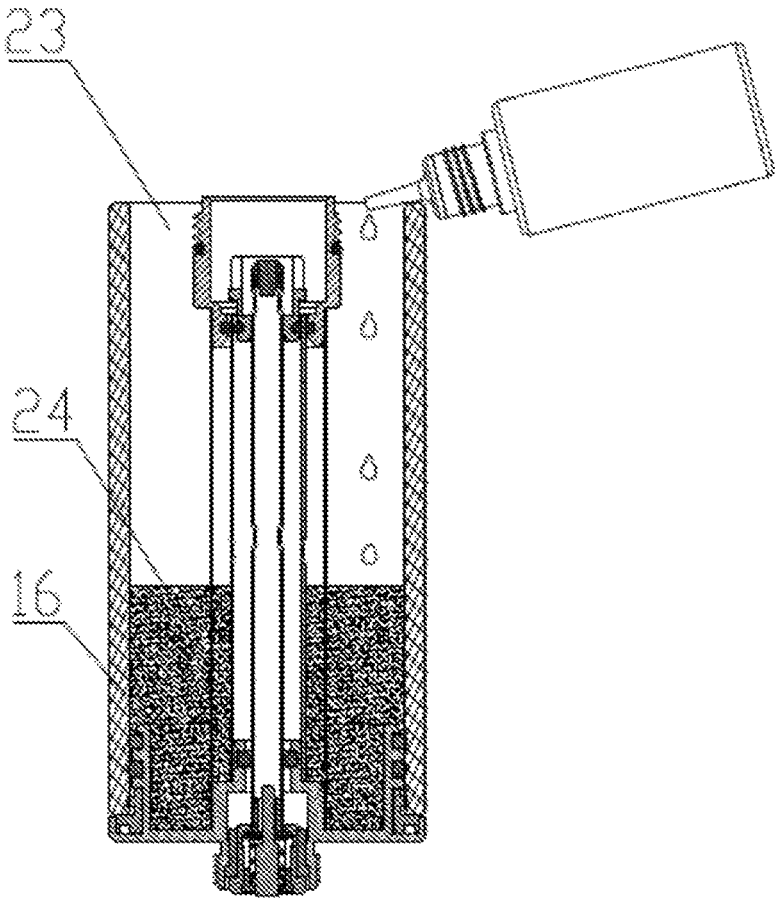
FIG. 6 is an overall schematic sectional view of a filter component of the present disclosure.

A silicon seal is provided at a joint between the baking component and the filter component; the mouthpiece component is in a threaded connection to the baking component, and a silicon seal is provided at a joint between the baking component and the mouthpiece component, so as to ensure seal of channels except the normal air flow channel, so that the filtrate is not leaked and the vapor is not leaked in the channels except the air flow channel. As shown in FIG. 6, after the filter component 300 disengages with the baking component, an open state is formed above the external pipe 16 and the filter pipe 15 so as to form a injection hole 23; in this way, a filtrate 24 can be added into the third space 19 via the injection hole, and the filtrate flows to the second space 18 via the through hole on the bottom part of the filter pipe. To prevent the filtrate from entering the first space via the through hole on the air outlet pipe 14 as much as possible, the amount of the filtrate should be controlled not to exceed the height of the through hole on the air outlet pipe 14.

By means of the foregoing implemented tobacco baking device, vapor generated by baking tobacco is filtered by liquid, so as to greatly reduce particle substances in the vapor, thereby reducing harms of smoking; the baking component is in a detachable connection to other components, so as to facilitate replacing components of the baking component and adding the filtrate for the filter component; multiple seal rings are provided at a joint between components in the entire tobacco baking device, so as to ensure that vapor is not leaked via connection seams between the components.

Preferable embodiments of the present disclosure are described above with reference to the accompanying drawings, and the embodiments are not intended to limit the scope of claims of the present disclosure. Any modification, equivalent replacement, or improvement that does not depart from the scope and essence of the present disclosure and is made by a person skilled in the art should fall within the scope of claims of the present disclosure.

What is claimed is:

1. A tobacco baking device, comprising a mouthpiece component, a baking component, and a filter component, wherein the filter component is located below the baking component; the mouthpiece component is located above the baking component; the baking component is detachably connected to the filter component; wherein there is sealed connection between the mouthpiece component and the filter component, and a sealed connection between the filter component and the baking component; and air flow channels are provided between the mouthpiece component and between the filter component and the baking component; the baking component bakes tobacco therein to generate vapor, and the vapor goes down along the air flow channel to the filter component, and goes up after being filtered by the filter component and is released via the mouthpiece component;

wherein the mouthpiece component further comprises a movable ring and a vent core, wherein the movable ring is provided outside the vent core; an air inlet hole and an air outlet hole are provided on the vent core; the air inlet hole is located between outside air and an inlet passage of the baking component, and communicates with outside air and an inlet passage of the baking component, and the air outlet hole communicates with an outlet passage of the mouthpiece component; the air inlet hole and the air outlet hole are opposite perforations provided on a wall of the vent core set in a vertically-crossed manner; a peripheral plane where the air inlet hole is located is not the same as a peripheral plane where the air outlet hole is located; wherein two seal rings are provided between the movable ring and the vent core such that when the movable ring moves upwards to a first location, the two seal rings move upwards with the movable ring and disengage from locations of the air inlet hole and the air outlet hole, so that the air inlet hole and the air outlet hole are in a communication state, when the movable ring moves downwards to a second location, the two seal rings move downwards with the movable ring to the peripheral plane where the air inlet hole is located and the peripheral plane where the air outlet hole is located respectively, so that the air inlet hole and the air outlet hole are blocked by the seal rings.

2. The tobacco baking device according to claim 1, wherein the baking component is in a detachable connection to the filter component, and a silicon seal is provided at a joint between the baking component and the filter component; a positive electrode, a negative electrode, and a sensor electrode are provided on an end portion of the baking component, where the baking component is butted with the filter component; a power supply positive electrode, a power supply negative electrode, and a sensor electrode are provided on an end portion of the filter component, where the filter component is butted with baking component; when the baking component is fixedly connected to the filter component, the positive electrode on the end portion of the baking component is butted with the power supply positive electrode of the filter component; the negative electrode of the baking component is butted with the power supply negative electrode of the filter component; and the sensor electrode of the baking component is butted with the sensor electrode of the filter component.

3. The tobacco baking device according to claim 1, wherein the filter component comprises an air inlet pipe, an air outlet pipe, a filter pipe, and an external pipe; wherein the air inlet pipe is inserted into the air outlet pipe, and a first space is formed between an outer wall of the air inlet pipe and an inner wall of the air outlet pipe; the air outlet pipe is inserted into the filter pipe, and a second space is formed between an outer wall of the air outlet pipe and an inner wall of the filter pipe; the filter pipe is inserted into the external pipe, and a third space is formed between an outer wall of the filter pipe and an inner wall of the external pipe; a first airflow hole is provided on a pipe wall of the air inlet pipe; a second airflow hole is provided on a pipe wall of the air outlet pipe; a third airflow hole is provided on a bottom part of the filter pipe; a filtrate is provided in the second space and third space; and a height of the filtrate does not exceed the second airflow hole's height on the pipe wall of the air outlet pipe.

4. The tobacco baking device according to claim 3, wherein the air inlet pipe, the air outlet pipe, the filter pipe, and the external pipe are all hollow pipes.

5. The tobacco baking device according to claim 3, wherein the filtrate is water or other liquid.

6. The tobacco baking device according to claim 1, wherein the mouthpiece component is in a detachable connection to the baking component, and a silicon seal is provided at a joint between the baking component and the mouthpiece component.

7. The tobacco baking device according to claim 1, wherein the baking component comprises a heater, an inner cavity, and an airflow pipe and a seal pipe that are provided outside of the heater; the airflow pipe is vertically connected to the seal pipe, and the seal pipe is provided below the airflow pipe; the inner cavity is provided in the heater; tobacco is provided in the inner cavity; and an airflow channel is formed between an inner wall of the airflow pipe and the seal pipe and an outer wall of the heater.

8. The tobacco baking device according to claim 7, wherein the heater comprises a heat insulation pipe, heat insulation cotton, and a heating pipe; the heat insulation cotton is provided in the heat insulation pipe; the heating pipe is provided in the heat insulation cotton; a heat sensitive sensor is provided on an outer wall of the heating pipe; the heating pipe is connected to a positive electrode and a negative electrode on the baking component; and the heat sensitive sensor is connected to a sensor electrode on the baking component.

9. The tobacco baking device according to claim 7, wherein the inner cavity is a tobacco pouch that is detachably mounted on the heater; multiple vent holes are provided on a wall of the tobacco pouch.

10. The tobacco baking device according to claim 1, wherein an air inlet and an air outlet channel are provided on the mouthpiece component; an intake air via the air inlet is mixed with vapor and then goes down to the filter component; the air outlet channel is connected to the filter component and a mouthpiece of the mouthpiece component, so that vapor filtered by the filter component is released from the mouthpiece via the air outlet channel of the mouthpiece component.

* * * * *